US007931224B2

(12) United States Patent
Chen

(10) Patent No.: US 7,931,224 B2
(45) Date of Patent: Apr. 26, 2011

(54) ROUND CUTTER-BLADE OF A PAPER SHREDDER

(75) Inventor: Kent Chen, Shanghai (CN)

(73) Assignee: Aurora Office Equipment Co., Ltd., Jiading District, Shanghai (CN)

( * ) Notice: Subject to any disclaimer, the term of this patent is extended or adjusted under 35 U.S.C. 154(b) by 127 days.

(21) Appl. No.: 11/556,438

(22) Filed: Nov. 3, 2006

(65) Prior Publication Data

US 2007/0152089 A1 Jul. 5, 2007

(30) Foreign Application Priority Data

Jan. 5, 2006 (CN) ..... 2006 2 0038735 U

(51) Int. Cl.
*B02C 7/04* (2006.01)
*B02C 13/20* (2006.01)

(52) U.S. Cl. ..... 241/236; 241/295

(58) Field of Classification Search ..... 241/295, 241/236

See application file for complete search history.

(56) References Cited

U.S. PATENT DOCUMENTS

| | | | | |
|---|---|---|---|---|
| 3,668,738 | A * | 6/1972 | Vertegaal | 452/120 |
| 3,991,944 | A * | 11/1976 | Baikoff | 241/36 |
| 5,897,066 | A * | 4/1999 | Bacon et al. | 241/160 |
| 7,401,747 | B2 * | 7/2008 | Bai | 241/295 |
| 2005/0109866 | A1 * | 5/2005 | Hunag | 241/295 |
| 2005/0109867 | A1 * | 5/2005 | Hunag | 241/295 |
| 2006/0102763 | A1 * | 5/2006 | Bai | 241/295 |
| 2007/0063084 | A1 * | 3/2007 | New | 241/295 |

* cited by examiner

*Primary Examiner* — Bena Miller
(74) *Attorney, Agent, or Firm* — Cozen O'Connor

(57) ABSTRACT

A round cutter-blade of a paper shredder includes a body having a surface, a periphery, and an opening formed therethrough; and at least one triangular shaped knife-edge that is integrally formed with the surface of the body and is turned over the periphery of the body. The cutter-blade can cut broken paper into short fragments, thus raising the secure requirement greatly and reducing the cost due to a reduction of thickness of the round cutter-blade.

11 Claims, 2 Drawing Sheets

ROUND CUTTER-BLADE OF A PAPER SHREDDER

TECHNICAL FIELD

The present invention relates to a parting tool, and in particular, to a round cutter blade of a paper shredder.

BACKGROUND

FIGS. 1 and 2 illustrate a conventional cutter-blade 12 that has a polygonal center hole 31, formed in a center thereof, that enables the cutter-blade 12 to pass through a rotational cutter arbor 21. A periphery of the conventional cutter-blade 12 protrudes forth, thereby shaping a knife-edge 121. The cutter-blade 12 has a great thickness (e.g., a thickness of at least about 2 mm) which increases the cost of the cutter-blade 12 due to its increased thickness.

In addition, during the process of breaking the paper, the paper can only be cut off into strips by the conventional cutter-blade 12. This limits the application and performance capabilities of the cutter-blade 12.

SUMMARY

The present invention seeks to overcome the above shortages existing in the prior art and provides a round cutter-blade of a paper shredder which is low in cost to produce and can be securely fitted and attached to other cutting parts of the paper shredder. The round cutter-blade according to one embodiment includes a body having a cutter spoke surface and one or more triangular shaped knife-edges are turned over a periphery of the cutter-blade body, with the number of knife-edges being 1, 2, 3, etc. At the center of the cutter-blade body, an opening (center hole) is formed.

The triangular knife-edge can make tri-turnings (bent in three locations) over the periphery of the cutter-blade so as to form three planes, and the elongation lines of the intersecting lines between adjacent planes do not intersect.

Further, the cutter spoke surface of the body that exists with the triangular knife-edges can have at least one rib or lug that protrudes outwardly therefrom. The number of ribs can be 1, 2, 3, etc.

Further, the periphery of the cutter-blade is a toothed periphery that is produced integratively with the body (e.g., during a punch forming operation).

The center hole of the cutter-blade can be a polygonal shaped hole.

Compared to the prior art cutter-blades, the cutter-blade according to one embodiment of the present invention provides a number of beneficial effects and advantages and in particular, since the cutter-blade is manufactured through punch forming with a sheet metal, the material consumption is less, thereby effectively reducing the production cost. In addition, the paper can be cut and punctured simultaneously so as to break the paper into short fragments due to the design of the triangular cutter-edge(s), thus meeting the secure requirement better.

BRIEF DESCRIPTION OF THE DRAWING FIGURES

DETAILED DESCRIPTION OF PREFERRED EMBODIMENTS

The present invention is now described in detail in company with embodiments and drawings as follows.

Figure 1:
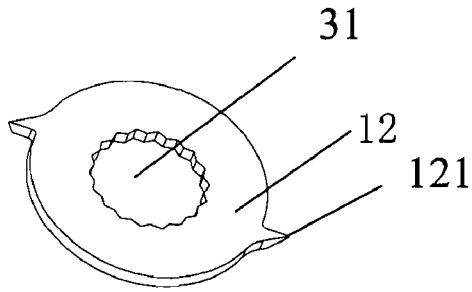
FIG.1 (PRIOR ART)
FIG. 1 is a perspective view of a conventional cutter-blade.
Figure 2:
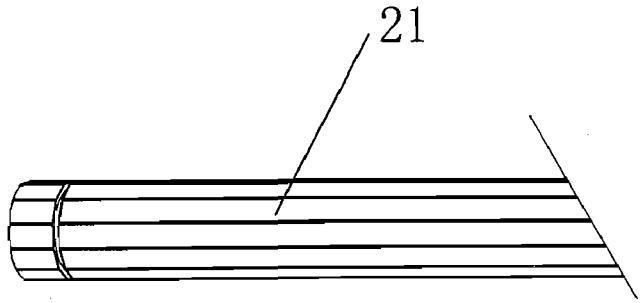
FIG.2 (PRIOR ART)
FIG. 2 is perspective side view of a conventional cutting arbor.
Figure 3:
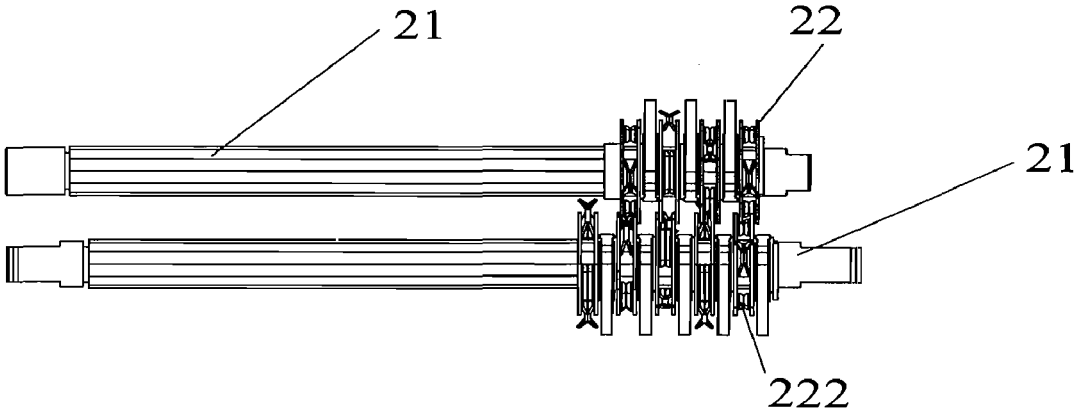
FIG. 3 is a side view of a cutting structure according to one embodiment of the present invention.
Figure 4:
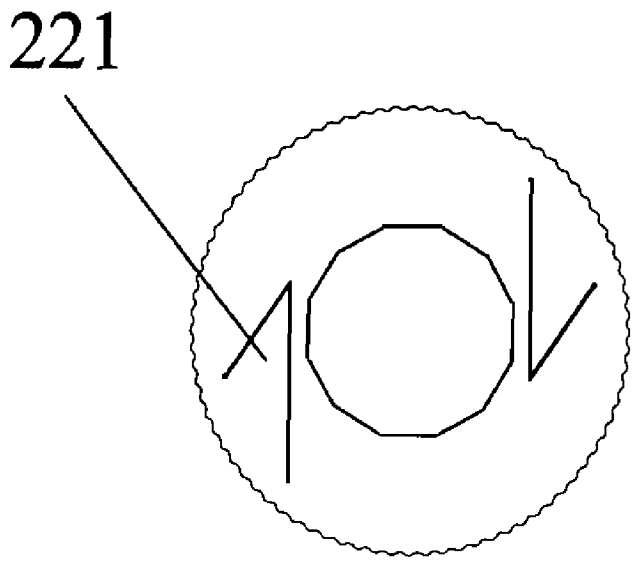
FIG. 4 is a top plan view of a cutter-blade according to one embodiment of the present invention shown in a transition state of triangular knife-edge just after a punch forming operation has been performed.
Figure 5:
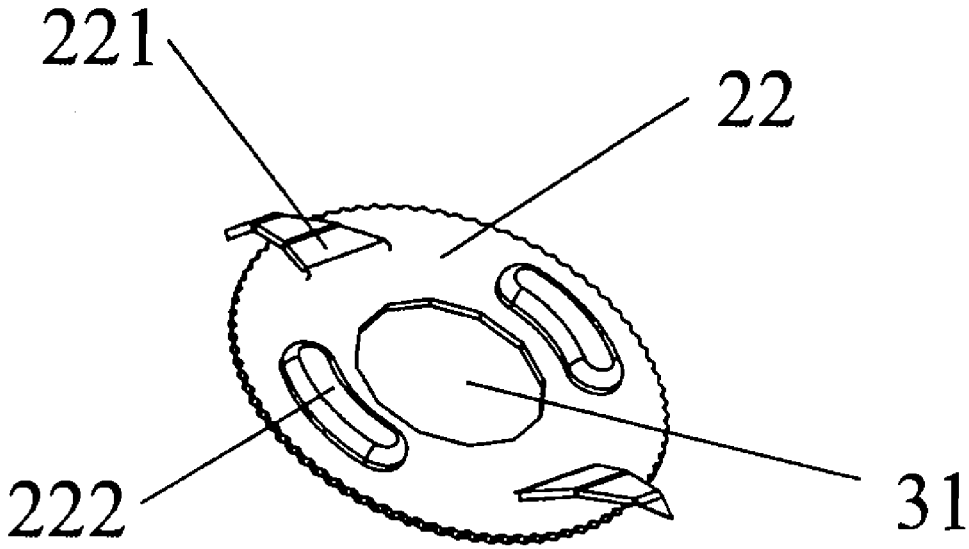
FIG. 5 is a perspective view of the cutter-blade according to the present invention.

Turning now to FIGS. 3-5, a round cutter-blade 22 according to one exemplary embodiment is illustrated. At the same surface of a cutter spoke of the round cutter-blade 22 of a paper shredder, triangular knife-edges 221 turning over a periphery of the cutter-blade 22 protrude symmetrically from the blade 22 and at a center of the cutter-blade 22, a center hole 31 is provided.

The round cutter-blade 22 of the present invention is made of a sheet metal, with its thickness being between 0.4 mm and 1.0 mm which is punched out round by means of a die. The cutter-blade 22 has a jagged periphery and its center hole 31 is a polygonal hole so that the round cutter-blade 22 can be fitted with the cutter arbor 21 in an improved manner.

After the round cutter-blade 22 is punched, the triangular knife-edge 221 in an equatorial state are set at its same surface preferentially, with two triangular knife-edges 221 in an equatorial state are set at its same surface, as shown in FIG. 4, and then the edges 221 are turned over the periphery twice, preferably, so that each triangular knife-edge 221 defined by two planes. If the edge 221 is turned over the periphery thrice, the edge 221 is defined by three planes and the two intersecting lines between every two adjacent planes are not intersecting, even along their elongation lines, as shown in FIG. 5. In other words and according to one embodiment, the knife-edges 221 can be initially formed as part of and in the same plane of the body of the cutter-blade 22 and then are turned over the periphery of the cutter-blade 22 by bending the knife-edges 221 in select locations.

The periphery of the round blade 22 is a toothed periphery that is produced integratively, and when two round blades 22 are rotating relatively, the periphery features permit the blade 22 to easily cut the paper.

At least one rib or lug 222 and generally two or more ribs 222 can be formed at the cutter spoke, which has the turned triangular cutter-edges 221. As shown in FIG. 3, the ribs 222 formed at the cutter spoke eliminate the need for using a cutter ring disposed between two conventional round cutter-blades of a cutter-blades set, which is commonly used in conventional cutter-blade. Because the width of a cutter ring is greater than the height of the rib 222, there is no need for a cutter ring between two round cutter-blades in a cutter-blade set so that the number of blades set along the axial direction can be increased.

What is claimed is:

1. A round cutter-blade of a paper shredder comprising:

a body having a surface, a-peripheral edge, and an opening formed therethrough; and at least one triangular shaped knife-edge that is integrally formed with the surface of the body beginning at a fold in the surface located inwardly from the peripheral edge, such that the at least one knife edge extends outwardly from the fold over the peripheral edge of the body.

2. The round cutter-blade of claim 1, wherein the triangular shaped knife-edge is bent in three locations as it is turned over the periphery of the body to define three planes and axes of the bend lines between two adjacent planes are parallel to one another and non-intersecting.

3. The round cutter-blade of claim 1, wherein the triangular shaped knife-edge is bent in two locations as it is turned over the periphery of the body to define two planes and axes of the bend lines between two adjacent planes are parallel to one another and non-intersecting.

4. The round cutter-blade of claim 1, wherein the periphery of the body of the cutter-blade is a toothed periphery.

5. The round cutter-blade of claim 1, wherein the periphery is a toothed periphery formed as a result of a punching operation that forms the body and the opening.

6. The round cutter-blade of claim 1, wherein the opening has a polygonal shape.

7. The round cutter-blade of claim 1, further including one or more ribs formed on the surface of the body and protruding therefrom.

8. The round cutter-blade of claim 7, wherein a direction that the knife-edge is turned over from the body surface is the same direction that the rib protrude from the body surface.

9. A cutter-blade of a paper shredder comprising:

a body having a surface, a toothed peripheral edge, and an opening formed therethrough; and at least one knife-edge that is integrally formed with the surface of the body and is bent in one or more locations beginning at a fold in the surface located inwardly from the peripheral edge, such that the at least one knife edge extends outwardly from the fold over the peripheral edge of the body.

10. A cutter-blade assembly comprising:

at least one pair of cutter-blades, each cutter-blade including a body having a surface, a toothed peripheral edge, and an opening formed therethrough;

at least one knife-edge that is integrally formed with the surface of the body and is bent in one or more locations beginning at a fold in the surface located inwardly from the peripheral edge, such that the at least one knife edge extends outwardly from the fold over the peripheral edge of the body; and at least one rib formed on the surface of the body and protruding therefrom; and a cutter arbor received within the openings of the cutter-blades;

wherein the cutter-blades are arranged so that the rib of one cutter-blade is in at least selective contact with the rib of the other cutter-blade of the pair of cutter-blades.

11. The assembly of claim 10, wherein free ends of the knife-edges face away from one another when the cutter-blades are arranged on the cutter arbor and the ribs are in selective contact with one another.

* * * * *